US005602441A

United States Patent [19]

Ohsako et al.

[11] Patent Number: 5,602,441

[45] Date of Patent: Feb. 11, 1997

[54] VACUUM IONIZATION GAUGING TUBE

[75] Inventors: Nobuharu Ohsako; Toshio Kikuchi; Wakao Watanabe, all of Fuchu, Japan

[73] Assignee: Anelva Corporation, Tokyo, Japan

[21] Appl. No.: 935,214

[22] Filed: Aug. 26, 1992

[30] Foreign Application Priority Data

Sep. 6, 1991 [JP] Japan ..... 3-254552

[51] Int. Cl.[6] ..... H01J 27/00

[52] U.S. Cl. ..... 313/230; 313/93

[58] Field of Search ..... 313/230, 93; 315/111.91; 250/427

[56] References Cited

U.S. PATENT DOCUMENTS

| | | |
|---|---|---|
| 3,267,326 | 8/1966 | Hayward et al. . |
| 3,743,876 | 7/1973 | Redhead . |
| 3,839,655 | 10/1974 | Helgeland et al. . |
| 4,471,661 | 9/1984 | Edwards, Jr. . |

OTHER PUBLICATIONS

Practical Vacuum Technology (pp. 238–241 and 244–245, Aug. 1986).

New Wide–Range B–A Gauge from UHV to $10^{-1}$ Torr (Journal of Vacuum and Scientific Technology, 20(4), Apr., 1982.

The Influence of the Grid and Ion Collector Diameters on the Sensitivity Factor and the Measuring Range of the Bayard–Alpert, Bulletin De L'Accademes, Polonaise Des Sciences Volumn XIX, No. 11–12, Sep., 1971.

*Primary Examiner*—Louis M. Arana
*Assistant Examiner*—Vip Patel
*Attorney, Agent, or Firm*—Wenderoth, Link & Ponack

[57] ABSTRACT

A vacuum ionization gauging tube, particularly a Bayard-Alpert (B-A) type vacuum ionization gauging tube, has a firmly compact construction, and provides the capabilities for minimizing outgassing gases and measuring pressures accurately without affecting the ultimate pressure range. The B-A vacuum ionization gauging tube includes a filament having a total surface area of between 6 $mm^2$ and 20 $mm^2$, a grid formed like a coil from a 0.1 mm to 0.3 mm diameter metal wire, the coil having a diameter of 5 mm to 7 mm and a length of 15 mm to 20 mm and across which it can be energized, an ion collector electrode having substantially the same length as the filament, and a metal envelope for enclosing the above electrode elements and which is maintained at a potential lower than that of the filament. The grid coil has a winding pitch of between 1.5 mm and 2.5 mm. The filament and grid are spaced apart from each other by the distance of between 2 mm and 4 mm. The metal envelope has an inner diameter of 20 mm to 30 mm, and the filament is located not more than 8 mm away from the inner wall of the metal envelope.

6 Claims, 5 Drawing Sheets

VACUUM IONIZATION GAUGING TUBE

BACKGROUND OF THE INVENTION

1. Field of the Invention

The present invention relates generally to a vacuum ionization gauging tube, and more particularly to the Bayard-Alpert (B-A) type vacuum ionization gauging tube to improve measurable capabilities and handling convenience.

2.Description of the Prior Art

It is known that the vacuum ionization gauging tubes are widely used to measure the pressures for a high- and ultrahigh-vacuum region. Typically, the conventional vacuum ionization gauging tube includes a hot-wire filament for emitting electrons, a helical grid having positive potential relative to the hot-wire filament for collecting electrons, and an ion collector having negative potential relative to the hot-wire filament for collecting positive ions. The electrons emitted from the hot-wire filament are being accelerated while traveling across the electric field developed by the grid, and are attracted to and collected by the grid. Some of those electrons collide against the gaseous molecules, therefore, producing positive ions which may be attracted to and collected by the negatively-biased ion collector. Those ions flow through the ion collector, therefore, ion current as an electric current value is measured by an ammeter externally connected to the ion collector. The measured electric current value is then converted to the corresponding pressure value.

There is a variety of vacuum ionization gauging tube types. One of them is known as the Bayard-Alpert (B-A) vacuum ionization gauging tube having the design as shown in FIG. 8. As seen from FIG. 8, this type of vacuum ionization gauging tube includes the filament, grid and ion collector as referred to above and which are arranged substantially coaxially such that the needle-like ion collector 23 is located on the axis of the tube structure and extends along the axis, the grid 22 is shaped like a spiral winding coil or a helical grid and surrounds the ion collector 23, and the filament 21 is disposed outside of the grid 22 and spaced away from it. There is another vacuum gauging tube that improves the previously described vacuum gauging tube in providing the capabilities for measuring the higher pressure range. This vacuum gauging tube further includes a supplemental or auxiliary electrode 24 that is disposed to surround the filament. An envelope 11 is usually made of glass, within which those electrode elements are arranged such that they can be hermetically isolated from the atmospheric pressure. In some types, the inner wall of the envelope 11 is coated with a metal film 25 which is grounded so that the inner wall of the envelope can be maintained a constant potential. The envelope 11 includes an outlet pipe 12 extending at right angles to a main portion of the envelope 11, and which is connected to a vacuum chamber system, container or the like being monitored from the outside.

FIG. 9 is a schematic diagram showing the potential gradient for each electrode shown in cross section. Those potentials are supplied by the external controlling power supply 31 connected to the ionization gauging tube. Specifically, the ion collector 23, the supplemental or auxiliary electrode 24, and the metal film coating or lining 25 are at the ground potential, whereas the filament 21 is biased positively and the grid 22 is at a higher positive potential. The potential difference between the filament and grid is usually set to about 150 volts which attains the maximum ionization efficiency for most gases. The thermoelectrons that are emitted from the hot-wire filament 21 are attracted by the grid 22 at the positive potential, being accelerated while traveling toward the grid 22. The electrons that have passed the grid 22 are influenced by an electric field developed by the ion collector, and are thus being decelerated and repelled back to the grid 22. In this manner, those electrons may have oscillations while cycling about the gird 22. Some of the electrons may collide against the gaseous molecules, producing positive ions. Those ions are attracted by the electric field across the ion collector 23, and are collected by the ion collector 23. The ions are measured as ion current within the externally-connected controlling power supply system 31, and the ion current value is converted to the corresponding pressure value. For this current-to-pressure conversion, the electron current value as measured is used, but the gaseous molecules have a high density in the pressure range of above $10^{-3}$ Torr, which may produce positive ions more frequently. Those positive ions may be attracted by the filament having negative potential, therefore, collected at the filament. This may cause great errors when the electron current value is read. Measuring the accurate current value is therefore practically impossible. In order to avoid this, there is another vacuum gauging tube that is capable of measuring in a pressure range higher by two orders than the typical B-A ionization gauging tube, i.e., up to $1\times10^{-1}$ Torr, wherein a supplemental or auxiliary electrode 24 is located adjacently to the filament 21 and has a lower potential relative to the filament, thereby reducing the possibility of the produced ions collecting at the filament. This vacuum gauging tube may be used for measuring the pressures during the sputtering process in particular (N. Ohsako "A new wide-range B-A gauge from UHV to $10^{-1}$ Torr", J. Vac. Sci. Technol., 20 (4), April 1982, pp. 1153–1155). The glass envelope also is coated or lined with the metal film 25 on the inner wall. Therefore, it prevents the inner wall from being charged by the ions that have been accumulated on the inner wall for the higher pressure measurement. Thus, it may serve to maintain the electrode elements inside at the constant potentials, respectively.

Typically, the conventional ionization gauging tube as described above has the geometrical and dimensional requirements for each of its constituent electrode elements, as set forth below. The glass envelope 11 usually has a cylindrical shape having a diameter of 50 mm to 60 mm and a length of 100 mm to 150 mm. The filament 21 is 40 mm to 50 mm long, and may be shaped like a straight needle, spiral coil, or hair pin. The grid 22 is made of a tungsten wire having a diameter of about one (1) mm, which is usually formed like a coil having a diameter of 15 mm to 25 mm, a length of 20 mm to 30 mm, and a winding pitch of about three (3) mm. Gases are degassed from the grid itself as well as constituent elements surrounding it, such as the filament or the inner wall, by heating the grid when the coil is energized across it to cause current to flow through it. Alternatively, the electron bombardment heating method may be employed instead of the coil grid heating method. In the ionization gauge employing this method, the grid is not coiled, and therefore is not energized across the current flow. In this method, the grid is operating in potential and electron current modes during the degassing stage which are normally different from those during the pressure measurement stage. For this reason, it has the disadvantage in that the pressure measurement cannot be performed during that time. Thus, the gauge employing this method only has the particular application where the ultra-low pressures are measured for experimental purposes. It is therefore not adequate for any other practical applications such as an industrial fabrication process.

The ion collector 23 is usually made of a tungsten wire having a diameter of about 0.2 mm and a length of 40 mm to 50 mm. The supplemental or auxiliary electrode is usually made of a metal banked like a semi-cylindrical shape having a diameter of 5 mm to 10 mm, and a length slightly greater than the filament.

It may be appreciated from the foregoing description that as one of the vacuum ionization gauging tube types, the Bayard-Alpert (B-A) type vacuum ionization gauging tube is an established technology, providing its performance, and has widely been used in measuring the vacuum pressures. According to the conventional type, all measuring constituent elements are accomodated in glass envelope which is liable to breakage when it is subject to any external force. It is therefore impossible to install it in any area where there is a risk of breaking the envelope. This imposes restrictions on the design of the vacuum system in which pressures are to be measured. Special care is also required during the maintenance service. Breakage may occur if the gauging tube is handled improperly or carelessly. For example, the envelope would easily be broken if a tool or part of the human body bumps against it inadvertently. If this occurs, the vacuum chamber would be exposes to the atmospheric pressures. To avoid this situation, any suitable covering may be provided for protecting the entire gauging tube. In this case, it is difficult to install the gauging tube within a limited space. For those years, the vacuum system has become more sophisticated and complicated, and contains many different components or elements within the limited space. In order to solve the above problem and thereby provide an ionization gauging tube that will never break, there is an ionization gauging tube whose measuring electrode elements are all accomodated in metal envelope, rather than glass one. For the metal type vacuum gauging tube, the radiant heat produced from the filament will irradiate on the metal envelope, raising the temperature of the metal envelope so as to degas more gases. This type ionization gauging tube usually includes cooling means for cooling the inner wall of the metal envelope. Without such cooling means, in the ultimate pressure range it is impossible to measure the pressure. In fact, the pressure measurement could not be made.

SUMMARY OF THE INVENTION

The present invention is provided to eliminate the problems described above. It is therefore the object of the present invention to provide vacuum ionization gauging tube that has a firmly compact construction, and is capable of measuring the ultimate pressure range by controlling the outgassing of gases to a minimum.

In order to achieve the above object, the vacuum ionization gauging tube according to the present invention includes a filament having a total surface area of between 6 $mm^2$ and 20 $mm^2$, a provide of a fine metal wire having a diameter of 0.1 mm to 0.3 mm and formen like a coil having a diameter of 5 mm to 7 mm and a length of 15 mm to 20 mm and across which the coil is energized, an ion collector electrode having substantially the same length as the grid coil, and a metal envelope that contains the above-listed electrode elements and is maintained at a potential level below the potential of the filament. The filament, grid, and ion collector electrodes are arranged as in the B-A vacuum ionization gauging tube.

In the preferred form, the grid coil has a winding pitch of between 1.5 mm and 2.5 mm, the filament and grid are spaced apart by 2 mm to 4 mm, and the metal envelope has an inner diameter of between 20 mm and 30 mm. Preferably, the spacing between the grid and the inner wall of the metal envelope should be not more than 8 mm.

Refractory metal wires, such as tungsten, molybdenum and the like, that have a high melting point, may be used to form a grid.

According to the vacuum ionization gauging tube of the invention, as described later, the effect of the outgassed gases can be minimized, the ultra-low pressure up to $10^{-9}$ Torr can be measured, and the high pressures of up to $1\times10^{-1}$ Torr can be measured. As the metal envelope is used, it will never break under the conditions as mentioned earlier.

The vacuum ionization gauging tube according to the present invention includes a filament that has a total surface area equal to about one twentieth (1/20) that of the filament for the typical conventional ionization gauging tube, thereby reducing the radiant heat that may be emitted from the filament. At the same temperature, the radiant heat becomes lesser proportionally as the surface area of the filament becomes smaller. According to the invention, therefore, the radiant heat can be reduced considerably. In the vacuum ionization gauging tube, the filament generates an electron current of several 10 μA to several mA so that gaseous molecules can be ionized. As the electron current decreases with the reduction in the surface area of the filament, the filament must be operated at the higher temperature so as to compensate for the decreased electron current. Generally, the intensity of the electron current per unit area, which can be generated by the thermoelectronic cathode filament, will increase rapidly as the temperature of the filament becomes higher. The radiant heat per unit area generated from the filament also increases as the temperature of the filament increases. With the filament temperature over the range between 1000° C. and 3000° C., the increase in the emitted electron current will be far greater than the increase in the radiant heat. This means that the radiant heat can be reduced by about one tenth (1/10) even if the temperature rises. If the filament temperature is raised with a reduction in its surface area, the radiant heat from the filament may be decreased accordingly. In this case, however, the filament material will be evaporated at a higher rate, which will shorten the life of the filament. This is not desirable for the practical purposes. From experimental results of the inventors of this application, it is found that the effective surface area of 6 $mm^2$ is the critical value in view of the life of the filament, whereas the effective surface area of 20 $mm^2$ is the critical value in view of the radiant heat. The potential gradient between the filament and grid may be increased by reducing the spacing between them to less than 4 mm. In this way, the filament emits more electrons, but nevertheless the requirements for raising the filament temperature is mitigated. If the spacing between the filament and grid is set to less than 2 mm. It would become more difficult in workability to fabricate such a tube structure, and the gauging sensitivity for pressure would be reduced Considerably. Those are found from the study by the inventors, and are not desirable.

According to the present invention, the vacuum ionization gauging tube has an electrode arrangement and electrode dimensions such that the total geometric volume of the ionization gauging tube is miniaturized, and thereby, the amount of the degassed gases is reduced. For example, the grid includes a coil made from refractory metal wire having a diameter from 0.1 mm to 0.3 mm and having a high melting point, such as tungsten, molybdenum and the like, and across which it can be energized, the coil having a diameter of between 5 mm and 7 mm, a length of between 15 mm and 20 mm, and a winding pitch of between 2 mm and 3 mm. The grid has a bulk that is equal to about one hundredth (1/100), and a total surface area that is equal to about one twentieth (1/20), as compared with the respective ones for the typical conventional vacuum gauging tube. Thus, the amount of outgassing gases can be considerably reduced. The down-sized grid reduces the geometric volume surrounding the grid that may affect the gauging sensitivity. The reduction amounts to one twentieth of the geometric volume for the conventional gauging tube. The vacuum ionization gauging tube according to the present invention has the following constructional features that prevent a reduction in the sensitivity for pressure:

(1) The coil diameter of the grid has been reduced, and the ion collector is aligned on the central axis of the grid, and has negative potential with regard to the grid. Thus, the intensity of the electric field developed by the ion collector and grid can be increased.

(2) The grid has a higher ratio of its length relative to its diameter. In this way, ions cannot escape from either of the opposite ends of the grid coil, increasing the ion collecting efficiency.

(3) As described above, the filament is down-sized, and can be operated at higher temperatures. Despite this, the filament is capable of emitting substantially as much electron current as that in the typical conventional vacuum gauging tube.

(4) The gauging sensitivity for pressure depends upon the winding pitch for the grid coil. The study by the inventors demonstrates that the optimum winding Ditch for the down-sized grid coil is in the range between 1.5 mm and 2.5 mm.

According to the vacuum ionization gauging tube comprising the above features, the reduction in the sensitivity can only be limited to one half the sensitivity of the conventional vacuum gauging tube.

In the vacuum gauging tube, the geometric shape of the metal envelope in which all the electrode elements are arranged is one of the important factors that may influence the characteristics of the ionization gauge. The metal envelope is maintained at the ground potential, and develops a coaxial, cylindrical electric field between the grid and the metal envelope. The filament is located between the grid and metal envelope, and has the intermediate potential relative to the potentials for the grid and metal envelope. Thus, the electrons emitted from the filament are repelled back toward the grid when traveling across the above electric fields. Those electrons behave in a manner in which they are cycling around the grid while oscillating, and can ionize the gaseous molecules very efficiently. In the prior art vacuum gauging tube, the glass envelope of which the inner wall is coated with the metal film is also maintained at the ground potential, and the spacing between the grid and the metal film coating is usually in the range between 15 mm and 25 mm. In contrast, in the ionization vacuum gauging tube according to the present invention, the grid has a smaller diameter, and the metal envelope has an inner diameter (about 24 mm). that is reduced to compensate for the reduction in the spacing between the filament and the grid, thereby providing the smooth potential gradient inside and outside the grid. It is also noted that when the inner diameter of the metal envelope is reduced, and the spacing between the inner wall of the metal envelope at the ground potential and the filament is also reduced to less than 8 mm, the inner wall of the metal envelope in the ionization gauging tube of the invention can also have the function of the supplemental or auxiliary electrode (24 in FIG. 2) in the wide pressure range type ionization gauging tube that prevents ions from collecting at the filament. The pressures that the vacuum gauging tube can measure can be extended up to $1\times10^{-1}$ Torr.

The construction of the vacuum ionization gauging tube according to the present invention has been described. In this ionization gauging tube, the power requirements for igniting the filament and then causing the filament to generate an emission current of several 10 μA to several mA may be reduced to one tenth or less, as compared with the conventional ionization gauge that contains the electrode elements each of the typical size. Using the metal envelope will not affect the outgassing of gases, and the ultra-low pressures of up to $10^{-9}$ Torr are measured. Although the spatial region in which the ionization occurs is smaller than the conventional ionization gauging tube, the larger potential gradient may provide the larger electron spatial density in which the ionization may take place. Furthermore, the ion collector may provide better ion collecting efficiency which enhances the gauging sensitivity for pressure. Additionally, the inner wall of the metal envelope that has lower potential with regard to the filament is located behind the filament such that the former is adjacent to the latter. Thus, the inner metal wall provides the equivalent function of the supplemental or auxiliary electrode that prevents ions from collecting at the filament, thereby minimizing any loss of the effective emission current. The upper high pressure limit that is measured can thus be attainable up to $1\times10^{-1}$ Torr.

BRIEF DESCRIPTION OF THE DRAWINGS

Those and other objects, features, and advantages of the present invention will become more apparent from the detailed description of several preferred embodiments that follows with reference to the accompanying drawings, in which.

DESCRIPTION OF PREFERRED EMBODIMENTS

Figure 1:
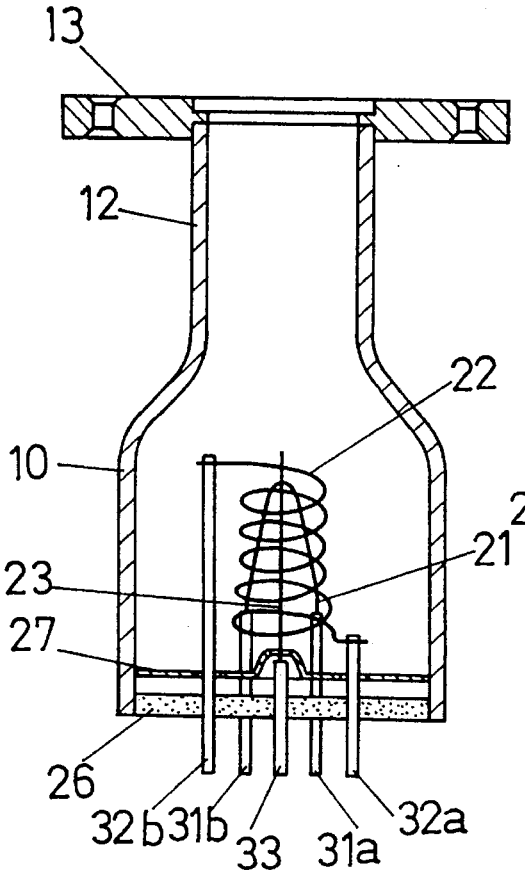
FIG. 1 is a schematic diagram showing one preferred embodiment of the present invention, in which FIG. 1 (*a*) is a front view in a longitudinal cross section, FIG. 1 (*b*) is a side view in a longitudinal cross section, and FIG. 1 (*c*) is a transverse cross section view.
Figure 1:
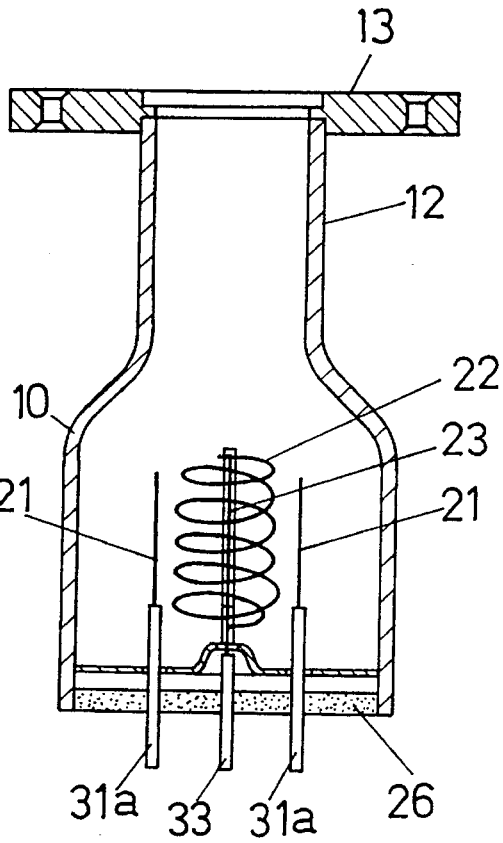
Figure 1:
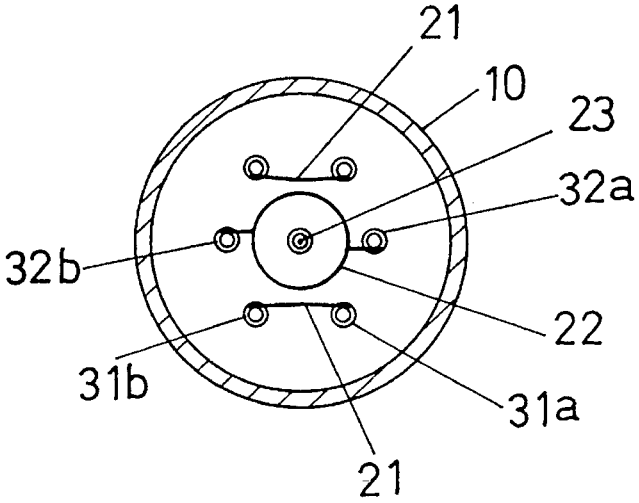

FIG. 1 illustrates one preferred embodiment of the present invention.

Referring to FIG. 1, a cylindrical envelope 10 is made of a metal such as SUS304, and has an inner diameter of about 24 mm. Filament 21 and a grid 22 are spaced from each other at a particular distance that allows the electrons emitted from the filament to follow their optimal orbit. To keep the filament 21 and the grid 22 spaced at that distance, the inner diameter should preferably be equal to 24 mm. The metal envelope 10 is at the ground potential through a ground cable or a vacuum chamber to which the ionization gauging tube is connected.

As seen in FIG. 1, the metal envelope 10 includes an outlet pipe 12 at its upper portion to which the vacuum chamber is connected. The outlet pipe 12 has a coupling flange 13 at its upper end, through which the metal envelope 10 is coupled with the vacuum chamber. This coupling flange 13 may be omitted, in which case the O-ring seal may be provided through which the outlet pipe 12 may be connected to the vacuum chamber.

The metal envelope 10 further includes a plurality of pins at the bottom, extending through the bottom into the metal envelope and electrically isolated by an insulator 26. Each of the pins supports the respective corresponding electrode element, and applies voltage for operating the electrode element.

An ion collector 23 is made of about 0.2 mm-diameter tungsten wire, and is aligned on the center axis through the metal envelope 10, extending up to the upper end of the grid 22. The ion collector 23 is supported by a pin 33 at the bottom.

The grid 22 includes a coil formed of molybdenum wire having about 0.2 in diameter which has a platinum coating on the surface, and which surrounds the ion collector 23, the coil having the diameter of 6 mm, the length of 18 mm, and the winding pitch of 2 mm. The grid 22 is supported by pins 32*a* and 32*b* through which current flows, energizing the grid coil 22 so that it can be heated without interruption during the pressure measuring process.

The filament 21 is made of thoria-coated iridium wire having a diameter of about 0.2 mm, and is formed like a hair pin extending up to a height of about 12 mm. The filament 21 is provided in a pair, each one being supported by pins 31*a*, 31*b* and located at the position about 2.5 mm away from the grid 22. The filament 21 has a total surface area of 15 $mm^2$, and produces a radiant heat of about 2 watts when it is energized by flowing several mA electron current. This output heat value is equal to one tenth that for the typical conventional vacuum gauging tube, and is enough to reduce the gases that may be outgassed from the metal envelope 10 when its temperature is rising due to the radiant heat. The spacing between the filament 21 and the inner wall of the metal-envelope 10 is preferably set to about 6.5 mm. As more ions are produced in the higher pressure range, this spacing may prevent those ions from collecting at the filament 21. Otherwise, the electron current or even the pressures could not be measured accurately.

The ionization gauging tube further includes a shield 27 at the bottom that is disposed in parallel with the insulator 26. This shield 27 has the three functions. The first function is to protect the insulator 26 against pollution by any evaporants from the filament 21 and/or grid 22, which would otherwise deposit on the surface and affect the insulator 22 between the pins. The second function is to eliminate any errors in measuring the low pressures (those errors will be introduced by shifting the lower pressure limit upwardly) that would be caused by any residual X-ray current that arises when the inlet terminal pin 33 for ion collector 23 is exposed to X-rays from the grid 22, and the third function is to stabilize the potential across the lower end of the grid 22.

The dimensional and relative positional requirements for the component elements of the vacuum ionization gauging tube of the present invention, such as the filament 21, grid 22 and ion collector 23, must be determined. To be helpful in this determination, various relevant data has been measured, and the theoretical calculation has been performed.

Figure 2:
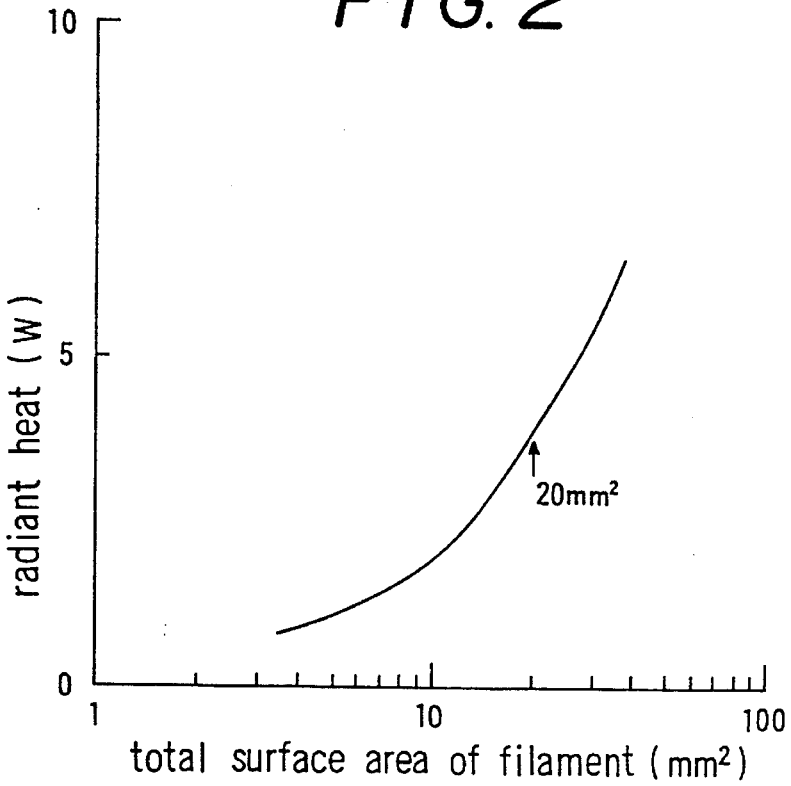
FIG. 2 graphically shows the relationship between the total surface area of the filament and the radiant heat of the embodiment.
Figure 3:
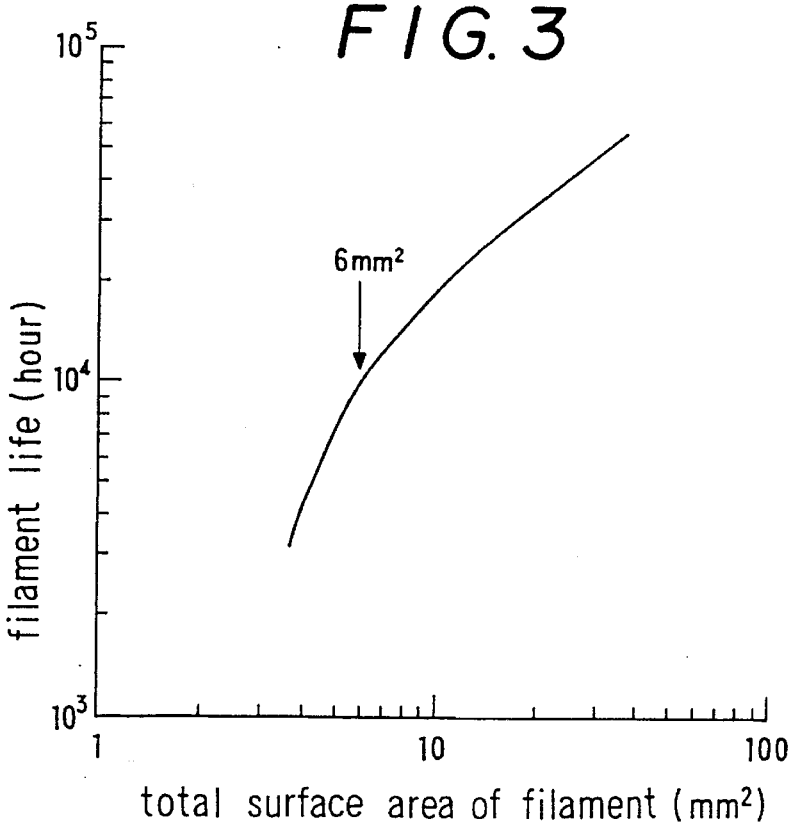
FIG. 3 graphically shows the relationship between the total surface area of the filament and its life, according to the embodiment.

FIG. 2 is a graph diagram representing the relationship between the total surface area of the filament and the radiant heat of the embodiment, when an emission current of 1 mA flows, and FIG. 3 is also a graph diagram representing the relationship between the total surface area of the filament and the life of the filament of the embodiment, when an emmision current of 1 mA flows.

It may be easily seen from FIG. 2 that the radiant heat will be increasing considerably as the total surface area of the filament exceeds the value of 20 $mm^2$. It may be easily seen from FIG. 3 that the life of the filament will become considerably shorter when the total surface area of the filament is less than 6 $mm^2$. Based on the above findings and the fact that if the radiant heat from the filament is not limited to below 4 watts, the outgassing gas may prevent the accurate measurement of the pressures, it has been determined that the filament should have the total surface area in the range between 6 $mm^2$ and 20 $mm^2$, which provides the optimum value range.

Figure 4:
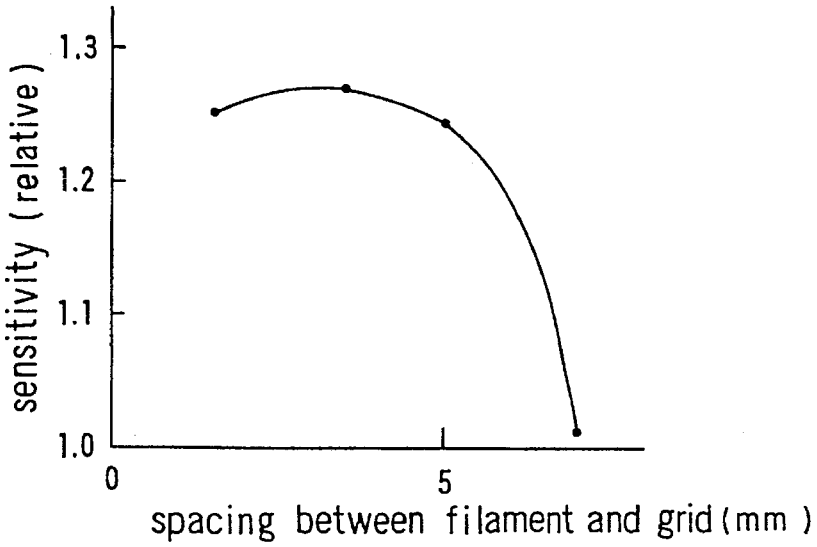
FIG. 4 graphically shows the relationship between the spacing between the filament and the grid, and the gauging sensitivity for pressure, according to the embodiment.

FIG. 4 is graph diagram representing the relationship between the spacing between the filament and the grid, and the gauging sensitivity for pressure (relative values) of the embodiment. It may be appreciated from FIG. 4 that the gauging sensitivity for pressure will vary as the spacing between the filament and grid varies. The graph shows that there is an almost flat region where the sensitivity remains unchanged in response to the variations in the spacing between the filament and the grid, which correspond to between 2 mm and 4 mm. Therefore, it has been determined that this value range is optimum.

Figure 5:
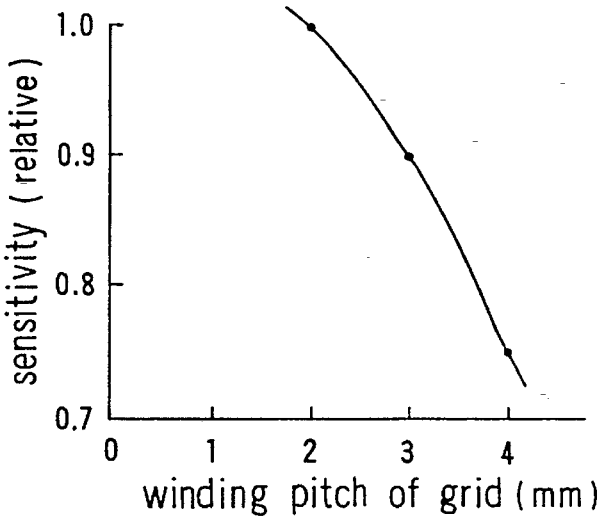
FIG. 5 graphically shows the relationship between the winding pitch of the grid coil and the gauging sensitivity for pressure, according to the embodiment.

FIG. 5 is a graph diagram representing the relationship between the coil winding pitch for the grid (grid pitch) and the sensitivity for pressure (relative values) of the embodiment. This graph shows that the sensitivity for pressure will decrease by 95% for the winding pitch of above 2.5 mm. Below 2.5 mm, the gauging sensitivity might become less reliable, and this is not desirable for practical and commercial purposes. For the winding pitch of less than 1.5 mm, it is practically difficult to manufacture the grid. Therefore, it has been determined that the winding pitch of between 1.5 mm and 2.5 mm will be optimum.

Figure 6:
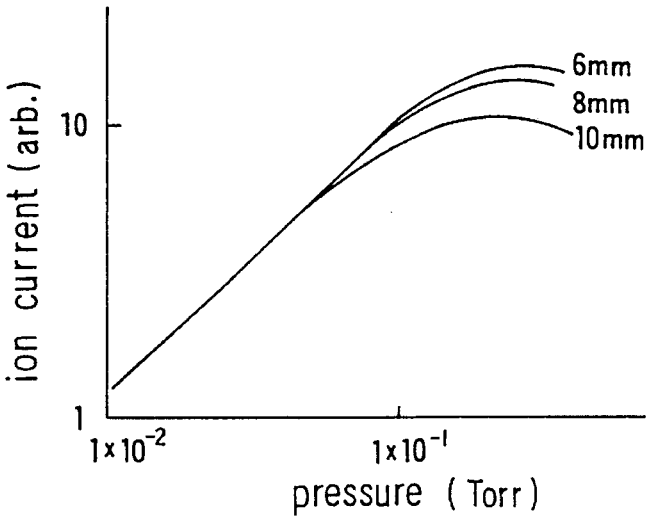
FIG. 6 grapically shows the relationship between the pressures and ion current of the embodiment when the parameter such as the spacing between the innerwall of the metal envelope and the filament has specific values.

Next, FIG. 6 is graph diagram representing the relationship between the pressure and ion current of the embodiment when the parameter such as the spacing between the inner wall of the metal envelope and the filament has specific values. It may be easily seen from the graph in FIG. 6 that the pressure and ion current have a linearity (i.e., constant linear relationship) within the pressure range below $1\times10^{-1}$ Torr. In order for the inner wall of the metal envelope to provide the function of the supplemental or auxiliary electrode that prevents ions from collecting at the filament, it has been determined that the optimum value for the spacing between the inner wall and the filament should be not more than 8 mm. On the contrary, the value for the spacing between the inner wall and the filament is more than 8 mm, or specifically the value is 10 mm, more ions will collecting at the filament, and the relationship between the pressure and the ion current will no longer be linear in the range of $1\times10^{-1}$ Torr.

Figure 7:
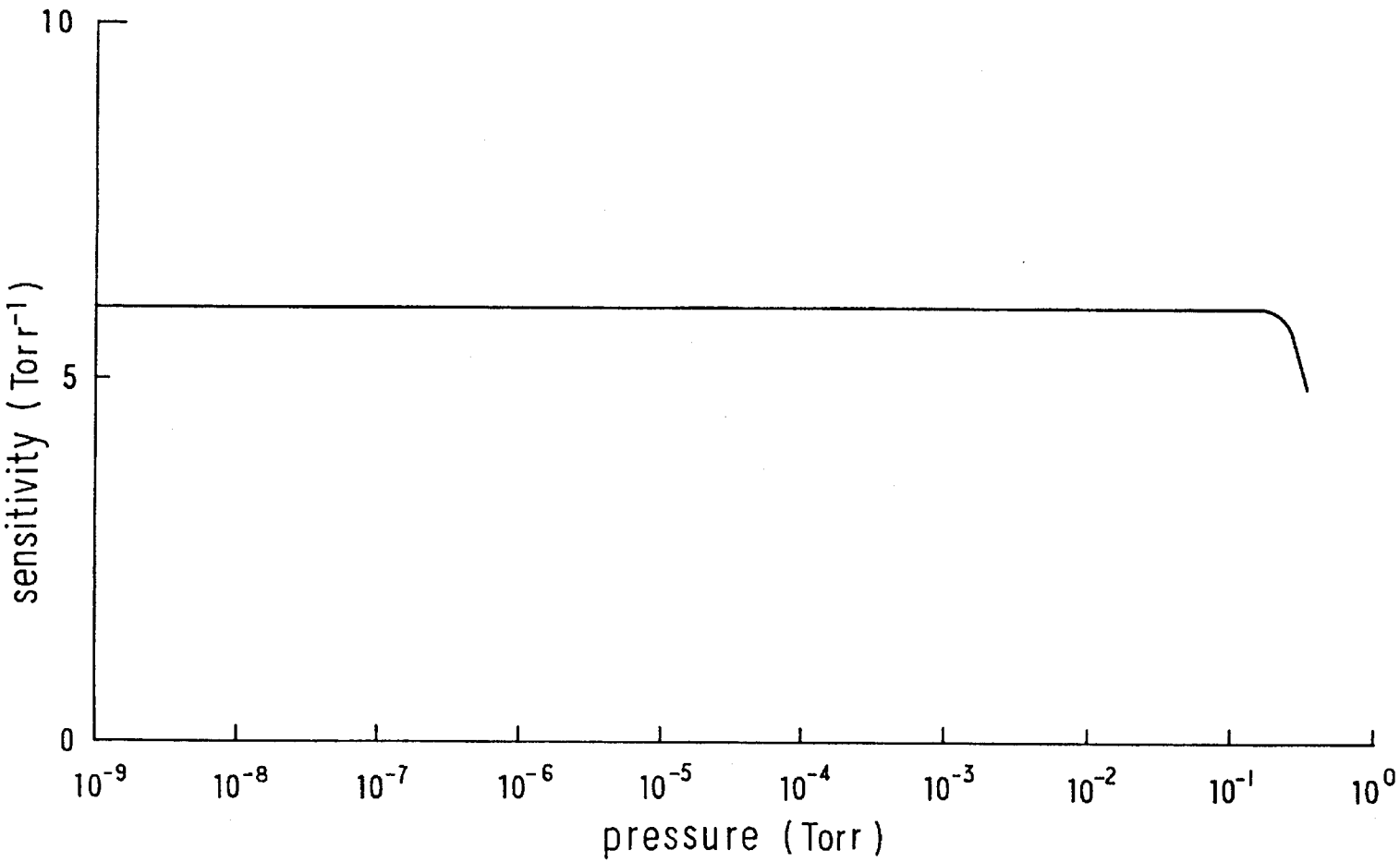
FIG. 7 graphically shows the relationship between the pressures and gauging sensitivity according to the embodiment of the present invention.
Figure 8:
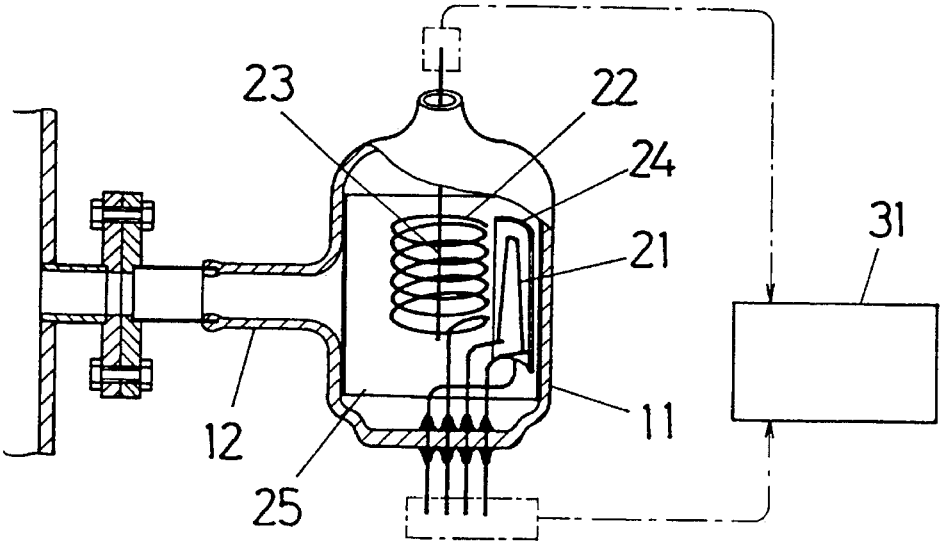
FIG. 8 PRIOR ART
FIG. 8 illustrates the arrangement of the conventional prior art ionization gauge enclosed in the glass tube, which is given for the purpose of reference.
Figure 9:
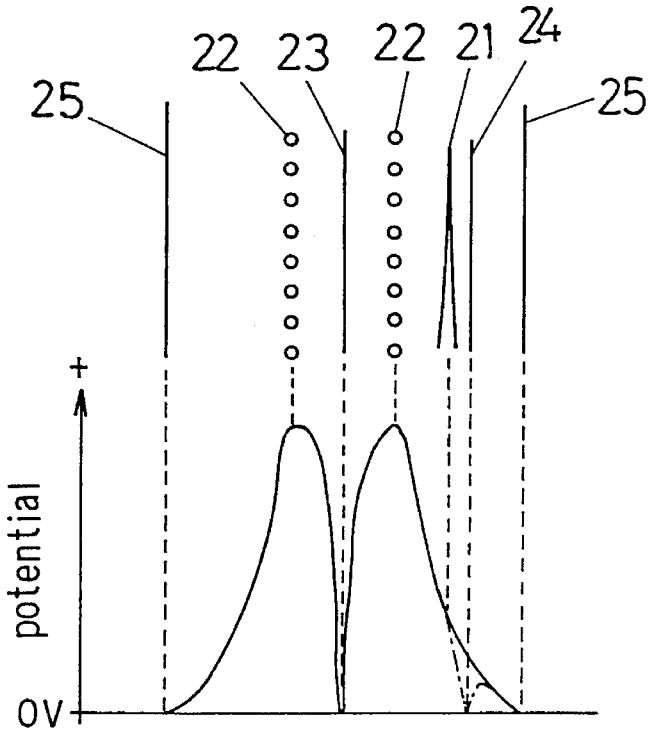
FIG. 9 PRIOR ART
FIG. 9 illustrates the potential gradient for each of the electrode elements in the ionization gauging tube of FIG. 8, which is also given for the purpose of reference.

FIG. 7 is a graph diagram representing the relationship between the pressures and gauging sensitivity according to the embodiment described above. In the embodiment, the ionization gauging tube provides a constant gauging sensitivity in the broad range between $1\times10^{-9}$ Torr and $1\times10^{-1}$ Torr. That is 6 $Torr^{-1}$.

When the ionization gauging tube is operated with the grid at the potential of 180 V, the filament at the potential of 45 V, and the metal envelope at the ground potential, it provides a constant sensitivity of about 6 $Torr^{-1}$ over the range from $10^{-9}$ Torr to $1\times10^{-1}$ Torr. At that time, the metal envelope is at about 40° C. on the surface, and the ultimate pressure of about $1\times10^{-9}$ Torr is reached. The ionization gauging tube has a volume of about 10 cc, which is miniaturized down to one twentieth that for the conventional glass gauging tube According to the present invention, the high vacuum (low pressure) can be measured by reducing the outgassed gases from the surface of the metal envelope. The ionization gauging tube according to the present invention may be built to include the metal envelope having a firmly compact construction, and the total size may be miniaturized down to one twentieth (1/20) the size of the conventional ionization gauge including the glass envelope, without dropping the sensitivity for pressure and the capability of measuring the higher pressure range.

As the envelope is made of metal, the coupling flange to which the vacuum chamber is connected from the outside may be soldered to the envelope by the usual soldering technique. Thus, the extra cost that may be required when the coupling flange is joined to the glass envelope can advantageously be saved.

Although the present invention has been described with reference to the several preferred embodiments thereof, it should be understood that various changes and modifications may be made without departing from the spirit and scope of the invention as defined in the appended claims.

What is claimed is:

1. A Bayard-Alpert (B-A) type vacuum ionization gauging tube comprising:

(a) a filament having a total surface area in the range between 6 $mm^2$ and 20 $mm^2$;

(b) a grid formed like a coil from metal wire having a diameter of 0.1 mm to 0.3 mm, said coil having a diameter of between 5 mm and 7 mm and a length of between 15 mm and 20 mm, and across which said coil can be energized;

(c) an ion collector electrode having substantially the same length as said grid coil;

(d) a metal envelope enclosing said filament, said grid and said ion collector electrode and maintained at a potential lower than the potential of said filament.

2. The B-A type vacuum ionization gauging tube as defined in claim 1, wherein said grid coil has a winding pitch in the range 1.5 mm to 2.5 mm.

3. The B-A type vacuum ionization gauging tube as defined in claim 1, wherein said filament and said grid are spaced apart from each other by a distance of between 2 mm and 4 mm.

4. The B-A type vacuum ionization gauging tube as defined in claim 1, wherein said metal envelope has an inner diameter of between 20 mm and 30 mm.

5. The B-A type vacuum ionization gauging tube as defined in claim 1, wherein said filament is located not more than 8 mm away from the inner wall of said metal envelope.

6. The B-A type vacuum ionization gauging tube as defined in claim 1, wherein said filament is made of thoria-coated iridium wire, and is formed like a hair pin extending up to a height of about 12 mm.

* * * * *